US005438851A

United States Patent [19]

Geissbuhler

[11] Patent Number: 5,438,851

[45] Date of Patent: Aug. 8, 1995

[54] BRACELET

[76] Inventor: Andreas Geissbuhler, Unterstrasse 8, 3360 Herzogenbuchsee, Switzerland

[21] Appl. No.: 10,806

[22] Filed: Jan. 29, 1993

[30] Foreign Application Priority Data

Feb. 5, 1992 [CH] Switzerland ..... 00328/92

[51] Int. Cl.[6] ..... A44C 5/00

[52] U.S. Cl. ..... 63/3; 63/5.1; 59/80

[58] Field of Search ..... 59/80, 79.1, 79.2; 63/3, 5.1

[56] References Cited

U.S. PATENT DOCUMENTS

| | | | |
|---|---|---|---|
| 973,601 | 10/1910 | Widenmeyer | 59/80 |
| 1,117,986 | 11/1914 | Döppenschmitt | 59/79.2 |
| 1,132,099 | 3/1915 | King | 59/80 |
| 1,607,808 | 11/1926 | Anthony | 59/79.2 |
| 1,666,033 | 8/1927 | Nittel . | |
| 3,693,375 | 9/1972 | Paulsen . | |
| 3,885,383 | 5/1975 | Tanaka | 59/79.1 |

FOREIGN PATENT DOCUMENTS

| | | |
|---|---|---|
| 1253314 | 1/1961 | France . |
| 133540 | 8/1929 | Switzerland . |
| 261450 | 8/1949 | Switzerland . |
| 280923 | 5/1952 | Switzerland . |

*Primary Examiner*—Michael J. Milano

*Attorney, Agent, or Firm*—Cushman, Darby & Cushman

[57] ABSTRACT

The characteristics and the appearance of a bracelet (12), produced from threads (25) of precious metal, are to be improved by a reinforcement (16, 17). The bracelet (12) has a tubular strap (15) in which a preferably elastic reiniforcement (16, 17) is located. The end of the reinforcement (16, 17) is attached to the end of the tubular strap (15) at both ends of a bracelet section.

7 Claims, 2 Drawing Sheets

Figure 8:
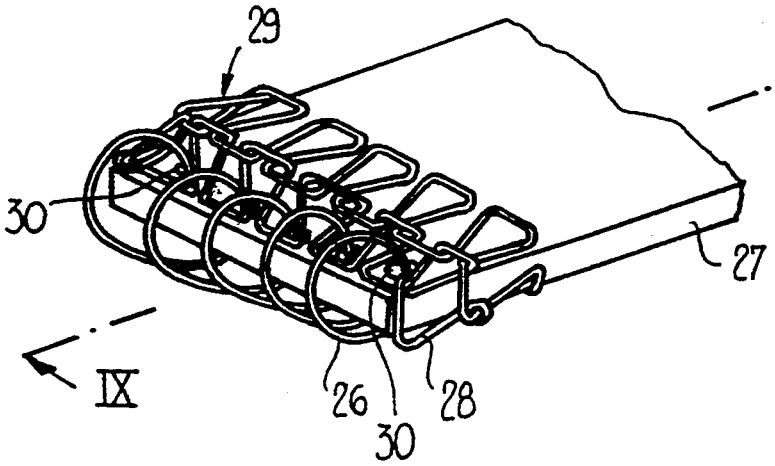

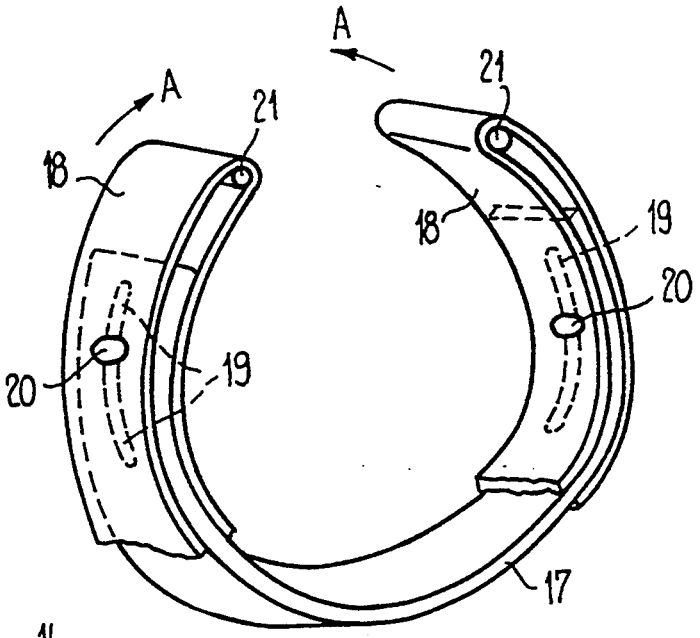
Fig.2
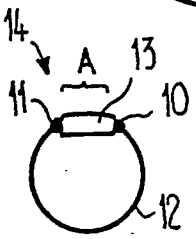
Fig.1
Fig.5
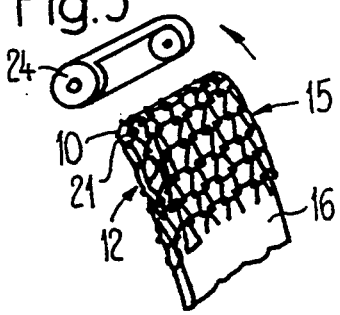
Fig.4
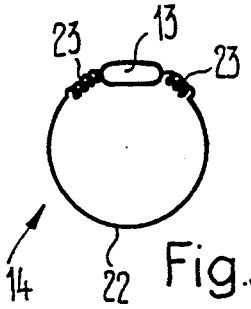
Fig.3
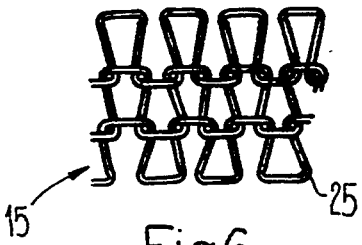
Fig.6
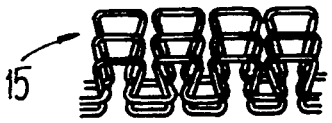
Fig.7

BRACELET

The invention relates to a bracelet. The invention relates, in particular, to a textile strap which is knitted from metal threads, for example threads of precious metal, and can be used, for example, as a bracelet.

The object to be achieved by the present invention consists in constructing the strap, on the one hand, to be so elastic that it can be attached to a watch by both its ends and can be moved by expansion over the wrist onto the arm without a fastener. On the other hand, a relatively rigid, non-transparent bracelet is to be provided.

This object is achieved according to the invention by a bracelet which is characterized by a tubular strap which is made of metal threads, a reinforcement in the tubular strap, and means for connecting the end of the reinforcement to the end of the tubular strap at the two ends of a strap section.

There is preferably a clasp in each case which connects the end of the reinforcement to the end of the tubular strap at each end of a strap section. There may be means which make elastic expansion and shortening of the bracelet possible. The tubular strap can have an elastomeric reinforcement. The reinforcement can be a means for giving the bracelet a solid appearance. The reinforcement can have a spring strap which is located inside the tubular expandable strap. The spring strap can have expandable members at its ends in order to guarantee the extensibility of the bracelet. The two ends of the expandable strap can be attached to an item of jewelry or a watch in order to form a wristwatch without a fastener. A U-shaped, bent spring strap can be arranged displaceably at each end of the spring strap. A watch can be attached to said spring straps which are bent in a U-shape. The strap of tubular construction can be a textile strap which is knitted from threads of precious metal, for example silver threads.

The displaceability of the spring strap bent in a U-shape can be bounded by a pin which protrudes into a elongate hole, the length of the elongate hole determining the length of the displaceability.

A substantial advantage of the strap according to the invention consists in the improvement of the appearance and the handling ability.

Exemplary embodiments of the expandable strap made of threads are described in detail below with reference to the enclosed drawing, in which:

FIG. 1 shows a lateral view of the strap in a diagrammatic illustration

FIG. 2 shows a reinforcement of the strap in a perspective illustration according to a first exemplary embodiment FIG. 3 shows a second exemplary embodiment of the strap in a diagrammatic illustration FIG. 4 shows one end of the strap in a perspective illustration FIG. 5 shows a tubular piece at the end of the strap in a perspective illustration FIG. 6 shows a piece of fabric of the tubular strap in a stretched position FIG. 7 shows a piece of fabric of the tubular strap in a compressed or pushed-together position FIGS. 8–11 show the connection of the strap to the reinforcement.

According to FIG. 1, the two ends 10 and 11 of a strap 12 are attached pivotably to a watch 13. The strap 12 is extensible or expandable so that the wristwatch 14 can be pushed by expansion over the wrist onto the arm without a fastener. This extension of the strap is possible in different ways, namely:

a) A fabric strap 15 in a flat-oval tubular shape (FIG. 4) can contain inside it an elastomeric strap 16 which forms a reinforcement in such a way that both the tubular fabric strap 15 and the elastomeric strap 16 having a generally rectangular cross-section and arranged inside the fabric strap 15 can be extended, expanded or widened to the extent that the wristwatch 14 can be pushed over the wrist onto the arm without a fastener.

b) A fabric strap or tube 15 in a flat-oval tubular shape (FIG. 4) can contain a spring strap 17 inside it (see FIG. 2). The spring strap 17, which forms a reinforcement, for example a steel strap, has at each end a spring strap 18 which is bent in a U-shape and can be displaced relative to the spring strap 17. In order to limit the displaceability of the spring strap 18, bent in a U-shape, on the spring strap 17, an elongate hole or slot 19 is provided at each end of the spring strap 17, through which elongate hole or slot a rivet 20 protrudes which is attached to the spring strap 18 bent in a U-shape. The displaceability of the spring strap 18, bent in a U-shape, relative to the spring strap 17 is provided by the length of the elongate hole or slot 19. Located at the end of the spring strap 18, bent in a U-shape, is a pin 21 with which the strap can be attached to the watch 13 in the usual manner.

To push the wristwatch 14 over the wrist, the spring strap 17 is bent up, the spring straps 18, bent in a U-shape, being displaced in the direction of the arrows A (FIG. 2). As soon as the spring strap 17 can be bent back into its initial position on the arm, the two spring straps 18, bent in a U-shape, are also pushed back into their initial position relative to the spring strap 17 counter to the direction of the arrows A. In this case, the tubular fabric strap 15 can expand from the compressed position according to FIG. 7 into the stretched position according to FIG. 6.

c) The fabric strap 15 can itself be of elastically expandable construction, for example by the threads, from which the fabric strap 15 was produced, themselves being of resilient or elastomeric construction.

d) The fabric strap 15 in a flat-oval tubular shape (FIG. 4) can contain inside it a spring strap or a woven material strap 22 (FIG. 3) which has at both ends either a helical spring 23 or an elastomeric strap 23 in such a way that, when the wristwatch 14 is pushed over the wrist onto the arm, only the helical springs or the elastomeric strap 23 expands and contracts again.

FIGS. 6 and 7 illustrate a knitted fabric for the tubular fabric strap 15. Of course, an elastic, tubular strap can also be used which is produced in a different manner, e.g. woven.

According to FIGS. 4 and 5, the end 10, 11 of the fabric strap 15 can be inserted in a tubular piece 24 which is then attached to the watch 13 by the pin 21 in the usual manner.

The expansion of the fabric 15 from the compressed position according to FIG. 7 into the stretched position according to FIG. 6 allows the length of the fabric strap to change when the wristwatch 14 is pushed over the wrist onto the arm.

The fabric strap 15 is produced, for example, from threads 25 of precious metal. The elongate holes or slots 19 can serve for guiding the spring strap 18, bent in a U-shape, relative to the spring strap 17.

Figure 9:
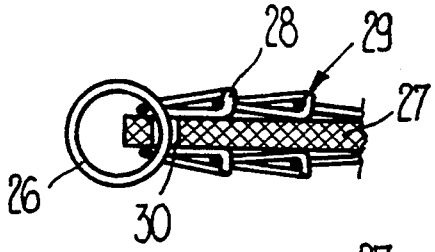
Figure 10:
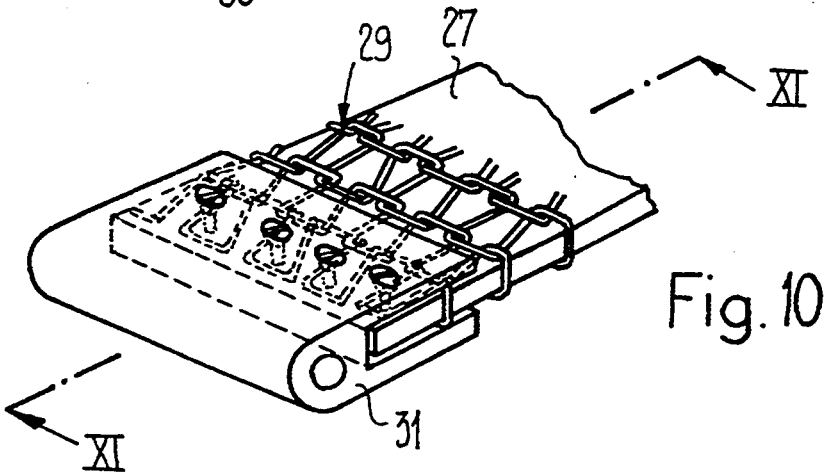
Figure 11:
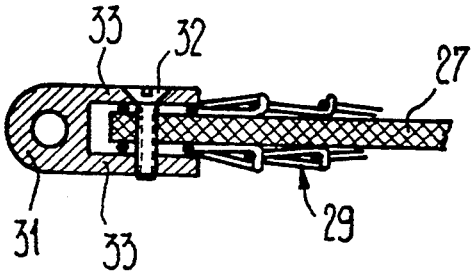

According to FIGS. 8 and 9, the end of the reinforcement 27 can be connected to the end of a tubular textile strap 29 with the aid of a helically curved wire 26. The wire 26 penetrates bores 30 of the reinforcement 27 on the one hand and stitches 28 of the textile strap 29 on the other hand. According to FIGS. 10 and 11, the end of the reinforcement 27 is firmly connected to the end of the tubular textile strap 29 with the aid of a U-shaped clasp 31. As can be seen from FIG. 11, in particular, there are screws 32 which penetrate the limbs 33 of the clasp 31, the stitches of the textile strap 29 and the reinforcement 27 and thus guarantee that the end of the textile strap 29 is rigidly connected to the end of the reinforcement 27.

Instead of threads of precious metal, threads of other metals, possibly With a surface treatment, can be used for the bracelet.

I claim:

1. A bracelet comprising:

a spring strap having first and second ends and having a generally rectangular cross-section;

a tubular strap having first and second ends and comprising metal threads; and means for connecting the first end of said spring strap to the first end of the tubular strap and for connecting the second end of the spring strap to the second end of the tubular strap such that the tubular strap surrounds said spring strap, said spring strap and said tubular strap each being constructed and arranged so as to change a length of the bracelet, wherein said spring strap is a metallic spring strap including means for adjusting a length thereof and said tubular strap is constructed and arranged to expand and contract.

2. The bracelet according to claim 1, wherein said connecting means comprises first and second clasps, said first clasp connecting the first end of said spring strap to the first end of the tubular strap, said second clasp connecting said second end of said spring strap to the second end of the tubular strap.

3. The bracelet according to claim 1, in combination with a watch coupled between the first and second ends of the spring strap.

4. The bracelet according to claim 1, wherein said adjusting means comprises U-shaped members, one U-shaped member being movably coupled to each first and second end of said spring strap.

5. The bracelet according to claim 4, wherein said spring strap includes slots adjacent said first and second ends thereof, and wherein each said]U-shaped member includes a protrusion cooperable with an associated slot to limit movement of the U-shaped member with respect to said spring strap.

6. The bracelet according to claim 4 in combination with a watch coupled between the U-shaped members.

7. The bracelet according to claim 1 wherein said tubular strap is knitted of precious metal.

* * * * *